US005293830A

United States Patent [19]

Goldbach

[11] Patent Number: 5,293,830

[45] Date of Patent: Mar. 15, 1994

[54] DOUBLE-WALLED VESSEL HULL CONSTRUCTION UTILIZING T-SHAPED SUBCOMPONENTS

[75] Inventor: Robert D. Goldbach, Millford, Pa.

[73] Assignee: Metro Machinc Corp., Norfolk, Va.

[21] Appl. No.: 33,357

[22] Filed: Mar. 18, 1993

[51] Int. Cl.[5] ..... B63B 3/02

[52] U.S. Cl. ..... 114/65 R; 114/79 W; 29/463

[58] Field of Search ..... 29/463; 114/65 R, 77 R, 114/78, 77 A, 79 R, 79 W, 355, 356, 72, 73, 74 R, 74 T, 74 A, 76; 228/182-184

[56] References Cited

U.S. PATENT DOCUMENTS

| | | | |
|---|---|---|---|
| 1,817,071 | 8/1931 | Ewertz | 114/79 W |
| 1,817,072 | 8/1931 | Ewertz | 114/79 W |
| 3,114,345 | 12/1963 | Abberly | 114/79 W |
| 4,638,754 | 1/1987 | Tornay | 114/79 R |
| 4,660,491 | 4/1987 | Murata et al. | 114/65 R |
| 5,085,161 | 2/1992 | Cuneo et al. | 114/65 R |
| 5,090,351 | 1/1992 | Goldbach et al. | 114/64 R |

FOREIGN PATENT DOCUMENTS

| | | | |
|---|---|---|---|
| WO87/02086 | 4/1987 | World Int. Prop. O. | 114/65 R |

*Primary Examiner*—Edwin L. Swinehart
*Attorney, Agent, or Firm*—Cushman Darby & Cushman

[57] ABSTRACT

A subcomponent for a subassembly of a module of a longitudinal midbody for a double-walled vessel hull is fabricated by welding an edge of a rib to an intermediate location on a face of a hull plate. A plurality of such subcomponents are alternately arranged and positioned in a fixture so as to dispose a free longitudinal edge of a rib plate in juxtaposition with adjoining longitudinal edges of two outer hull plates, or with adjoining longitudinal edges of two inner hull plates. At each of these sites, the three adjoining edges are welded together, thereby fabricating subcomponents into subassemblies. By preference, the hull plates are flat.

8 Claims, 1 Drawing Sheet

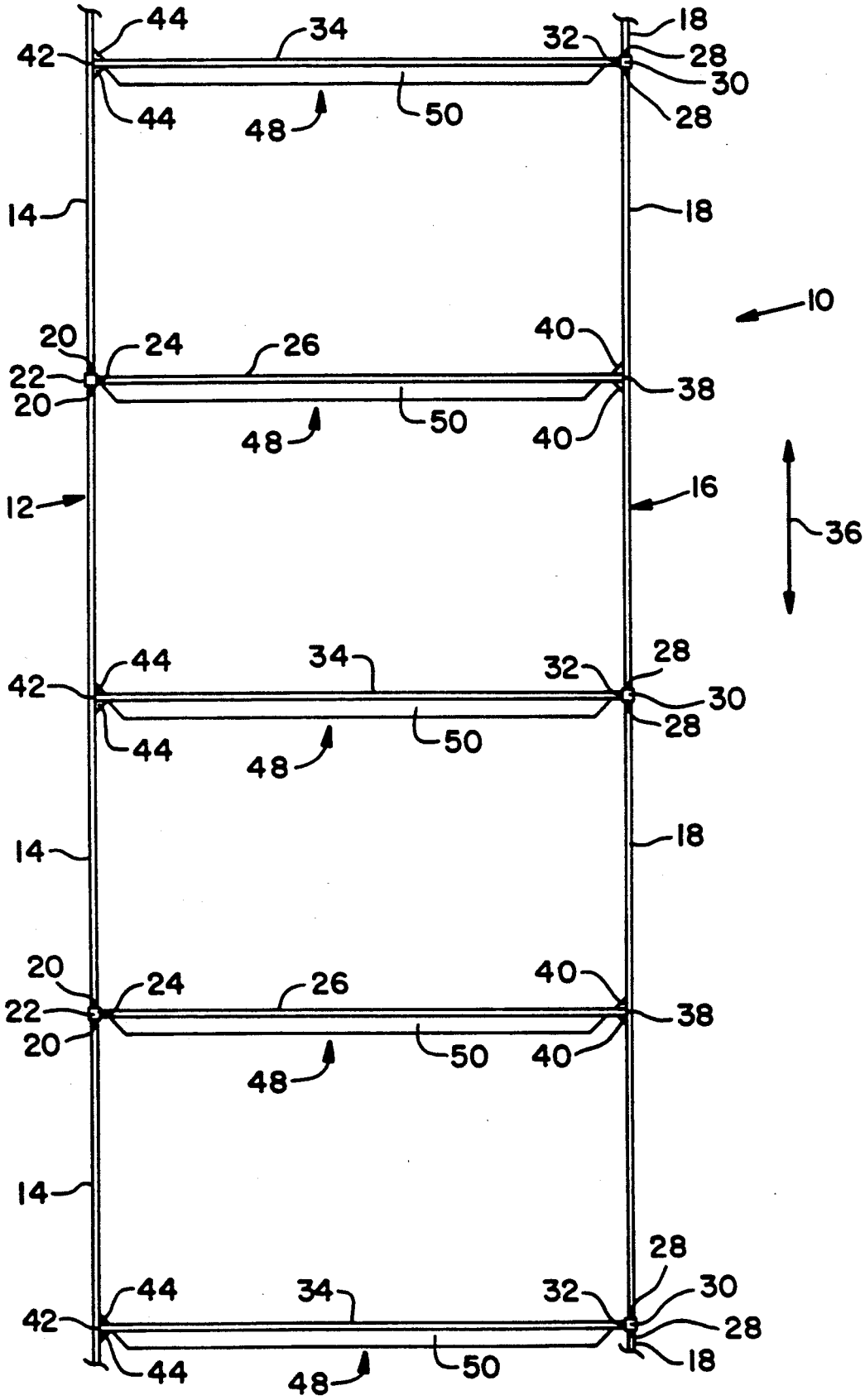
44
34
32
18
42
28
30
44
48
50
28
14
18
10
20
24
26
40
22
38
20
48
50
40
12
16
36
44
34
32
28
42
30
44
48
50
28
14
18
20
24
26
40
22
38
20
48
50
40
14
28
44
34
32
30
42
28
44
48
50
18

DOUBLE-WALLED VESSEL HULL CONSTRUCTION UTILIZING T-SHAPED SUBCOMPONENTS

BACKGROUND OF THE INVENTION

The U.S. Pat. No. 5,085,161, of Cuneo et al., issued Feb. 4, 1992, discloses and claims a method and apparatus for fabricating hull modules for the longitudinal midbody of a double-walled vessel, and for serially interconnecting those modules to provide a midbody, to which prefabricated bow and stern modules are added to constitute the vessel hull. Improvements in the method and resulting vessel hull constructions are disclosed in the U.S. Pat. No. 5,090,351, of Goldbach et al, issued Feb. 25, 1992.

In the methods and constructions as disclosed in these prior patents, the fundamental fabricated subcomponent is two inner hull longitudinal plates arranged edge-to-edge so as to have a first set of two adjoining longitudinal edges, two outer hull longitudinal plates arranged edge-to-edge so as to have a second set of two adjoining longitudinal edges, and a longitudinal rib plate arranged generally perpendicularly to the inner and outer hull plates, with one longitudinal edge thereof juxtaposed with and forming part of the first set of adjoining edges, and the opposite longitudinal edge thereof juxtaposed with and forming part of the second set of adjoining edges. The first set of three plate edges is welded together to form a first T-joint and the second set of three plate edges is welded together to form a second T-joint. The resulting fabricated subcomponent is H-shaped and made up of five plates and two welds. In practice, according to the methods disclosed as preferred in the two prior patents, a subassembly which is more complex than the fundamental subcomponent is fabricated in up-ended orientation in a fixture in which more than five plates are simultaneously welded at more than two joints so as to simultaneously create and serially interconnect a plurality of such subcomponents. In these prior art constructions, the plates forming the inner and outer hull walls are disclosed as being convexly curved, and the hull wall interconnecting rib plates are disclosed as being flat, although possibly being provided with lightening hole and welded-on kick-plate stiffeners.

An earlier U.S. Pat. No. 4,638,754, to Tornay, issued Jan. 27, 1987 discloses a double-walled vessel hull construction, also having curved hull plates and flat rib plates, but in which the longitudinal edges of the rib plates are welded to the hull plates at locations intermediate the longitudinal edges of the curved inner and outer hull plates. Thus, in Tornay, each H-shaped subcomponent is made up of three (rather than five) plates, and these subcomponents are serially interconnected by welding two adjoining inner hull plate edges to one another and two outer hull plate edges to one another. The vessel hull construction of the Tornay patent is disclosed as needing transverse deep webs for avoiding excessive build up of transverse forces at the lower corner bilges of the vessel hull construction. Also, according to the Tornay patent, the curved hull plates should be recurved (so that they have a "sea gull" shape as seen in end view) rather than a simple edge-to-edge convex shape as disclosed in the above-mentioned, later Cuneo et al. and Goldbach et al. patents.

Among the advantages to be gained by using curved hull plates, is thereby obtaining some stiffening so as to reduce or eliminate the need for transverse ribs between the hulls. The curvature may also help accommodate application of jacking forces onto the plates in the welding fixture, so as to force joint edges into proper alignment and spacing for welding as the module subassemblies are fabricated.

Among the advantages to be gained by welding three plate edges together at a T-joint (rather than only two edges together at a butt joint, or a plate edge to a plate face at a two-plate T-joint as in the Tornay patent) are increased ability to use more highly automated welding processes, in which part of the necessary backing for the joint as it is being welded, is the edge of the third plate being united by the weld, the lower number of welds needed for producing a subassembly, and facilitation of applying jacking forces on the plates in the welding fixture for aligning and uniformly spacing their edges for welding.

The type of construction disclosed in the above-mentioned Cuneo et al. and Goldbach et al. patents was conceived mainly for use in very large crude oil carriers and similar bulk liquid cargo vessels which are normally filled and emptied of cargo by pumping. However, as disclosed, their use is not limited to that field.

As environmental and ecological considerations have risen and become more prominent in the design of tankers, causing more vessel owners and others concerned with shipping to seriously look towards greater adoption and use of double-hulled vessels for shipping bulk cargo, it has become clear that there are instances where curved vessel hull plates are at a disadvantage for use in certain hulls, or in portions of certain hulls.

A prime example is a bulk carrier for granular material such as rock salt or pulverized phosphate rock, or lumber. Holds are mainly emptied using clamshell buckets or slings on cranes, with the assistance of a wheeled front-end loader or forklift truck lowered into the hold for emptying corners and moving the material towards a location where it can be efficiently crane-lifted out of the hold. If the vessel midbody is made of curved plate as disclosed in the aforementioned Tornay, Cuneo et al. or Goldbach et al. patents, it will be difficult to drive a wheeled front-end loader or forklift truck around on the floor surface of the bottom of the hold, and particularly difficult to scoop up or plow granular material, due to the undulating pattern of ridges and troughs.

SUMMARY OF THE INVENTION

A subcomponent for a subassembly of a module of a longitudinal midbody for a double-walled vessel hull is fabricated by welding an edge of a rib to a intermediate location on a face of a hull plate. A plurality of such subcomponents are alternately arranged and positioned in a fixture so as to dispose a free longitudinal edge of a rib plate in juxtaposition with adjoining longitudinal edges of two outer hull plates, or with adjoining longitudinal edges of two inner hull plates. At each of these sites, the three adjoining edges are welded together, thereby fabricating subcomponents into subassemblies. By preference, the hull plates are flat.

The principles of the invention will be further discussed with reference to the drawing wherein preferred embodiments are shown. The specifics illustrated in the drawing are intended to exemplify, rather than limit, aspects of the invention as defined in the claims.

BRIEF DESCRIPTION OF THE DRAWING

In the Drawing:

The sole figure shows an end view of three subcomponents, and parts of two others, as fabricated and welded together to provide a subassembly for a module of a double-walled vessel hull in accordance with principles of the present invention.

DETAILED DESCRIPTION

Except as described or evident from the context, the process and product of the present invention can be practiced and provided using the steps, the materials, and the apparatus, fixtures, and process conditions (including cleaning, holding, welding and coating techniques) which are disclosed in the aforementioned U.S. patents of Tornay, Cuneo et al. and Goldbach et al., for making the modules, longitudinal midbodies and vessels that are disclosed in them.

The Figure of the drawing shows, in end view, a representative portion 10 of a subassembly for fabricating a module of a longitudinal midbody of a double-hulled vessel, such as a bulk cargo carrier, very large crude carrier or the like, using the techniques disclosed in the above-mentioned U.S. patents of Cuneo et al. and Goldbach et al. (These patents disclose, for instance, relevant techniques for cutting plates to size, cleaning and painting them, positioning and holding them while welding them together, cleaning and painting surface regions disrupted by the welding process, welding of subassemblies (possibly including longitudinal bulkheads) to transverse bulkheads, welding of longitudinally successive modules to one another, and of bow and stern modules to the longitudinal midbody. All of those methods are appropriate to production to subassemblies, modules, longitudinal midbodies and vessels using the subcomponents of the present invention.

It is within the contemplation of the present invention to construct modules, longitudinal midbodies and vessels in which all of the hull portions (and longitudinal bulkheads, if present) of all of the midbody modules are made up of subcomponents constructed in accordance with principles of the present invention. It is also within the contemplation of the invention to produce subassemblies, midbody modules, and longitudinal midbodies in which only some of the subcomponents and/or only some of the subassemblies, and/or only some of the modules contain subcomponents constructed in accordance with the principles of the present invention, with the others being constructed of curved plate in accordance with the teachings of any of the above-mentioned prior U.S. patents of Tornay, Cuneo et al. and Goldbach et al., or in any other known way. For instance, it may be convenient to construct a bulk carrier in which the longitudinal midbody module subassemblies that will provide the bottom of the midbody are constructed of flat plates in accordance with the principles of the present invention, and the other subassemblies being constructed in accordance with the above-identified U.S patents of Tornay, Cuneo et al. or Goldbach et al.

It is also within the contemplation of the invention to provide that on at least some of the subassemblies, the subcomponent faceplates which will provide respective portions of one of the hulls (e.g., the inner hull) be flat plates, but that the subcomponent faceplates which will provide respective portions of the other of the hulls (e.g., the outer hull) be curved plates having simple curves as disclosed in the above-identified U.S. patents of Cuneo et al. or Goldbach et al., or have flying sea gull-shaped recurves as disclosed in the above-identified U.S. patent of Tornay.

For purpose of discussion, it will be assumed in regard to the drawing Figure, that the faceplates that, in use, form the inner hull 12 of the vessel are depicted at 14, and the faceplates that, in use, form the outer hull 16 of the vessel are depicted at 18.

In the inner hull 12, the adjacent longitudinal edges 20 of the respective longitudinally coextensive faceplates 14 ar joined together at respective welds 22 (each of which also involves a respective inner longitudinal edge 24 of a respective longitudinal rib plate 26).

In the outer hull 16, the adjacent longitudinal edges 28 of the respective longitudinally coextensive faceplates 18 are joined together at respective welds 30 (each of which also involves a respective outer longitudinal edge 32 of a respective longitudinal rib plate 34).

In a double-walled hull module subassembly 10, longitudinal rib plates 26 and 34 alternate with one another in the girthwise direction of the vessel (which is indicated by the arrow 36).

The outer longitudinal edges 38 of the rib plates 26 are welded at respective two-plate T-weld joints (with fillets 40) to respective faceplates 18 at respective intermediate sites which are spaced (preferably equidistantly) from longitudinally opposite edges 28 of respective faceplates 18 of the outer hull 16.

The inner longitudinal edges 42 of the rib plates 34 are welded at respective two-plate T-weld joints (with fillets 44) to respective faceplates 14 at respective intermediate sites which are spaced (preferably equidistantly) from longitudinally opposite edges 20 of respective faceplates 14 of the inner hull 12.

It is within the contemplation of the invention to create all of the welds 22, 30, 40 and 44 of one subassembly 10 simultaneously as the edges and surfaces of all of the plates which are to be welded are held in desired juxtaposition in a welding jig arrangement (of towers with jacks and spacers) such as is disclosed in the above-identified U.S. patents of Cuneo et al. or Goldbach et al. In conducting such a process, all the plates are arranged with their longitudinal edges extending vertically (i.e., as if the drawing figure were atop plan view), and the welding is simultaneously conducted at plural sites using electrogas or electroslag welders which proceed vertically up the joints being welded, each welding machine including cooled copper bar backing plates or the like for preventing outflow of molten weld material until the joint being formed has sufficiently solidified.

It is also within the contemplation to first form the two-plate T-welds at 40 and 44, using down-handed robotic welders as the plates 14 and 18 are conveyed along, horizontally, having the respective faces directed upward and the respective rib plate edges 24 and 32, are directed downward, and welded together, thereby fabricating respective two-plate, one-weld subcomponents 48, which are T-shaped in transverse cross-sectional shape (and in end view as shown in the drawing figure). The down-handed welding technique used may be similar to the plate edge flame cutting and the kick-plate stiffener-to-longitudinal rib-welding processes which are shown and described in the above-identified U.S. patents of Cuneo et al. and Goldbach et al. In this preferred embodiment, the subassembly 10 is then fabricated by erecting the subcomponents 48 in the aforementioned welding jig of the type disclosed in the above-identified U.S. patent of Cuneo et al. or Goldbach et al., and while holding the respective as yet unwelded sets of three edges 20, 20 and 24, and 28, 28 and 32 in desired juxtaposition, vertically upwardly welding the respective joints 22 and 30 by electrogas or electroslag welding, again using the techniques disclosed in the Cuneo et al. and Goldback et al. patents which are identified above.

The rib plates 26, 34, prior to their being welded to respective faceplates at respective welds 22 and 30, can be provided with respective lightening openings (not shown) and/or with respective welded-into-place kick-plate stiffeners 50, in the same manner as is disclosed for the comparable elements in the above-identified U.S. patents of Cuneo et al. and Goldbach et al.

(For convenience in discussion, the successive subcomponents 48 in the girthwise direction are stated to be rotated 180 degrees about respective longitudinal axes thereof relative to one another.)

It should now be apparent that the double-walled vessel hull construction utilizing T-shaped subcomponents as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A subassembly for a double-walled vessel hull construction, comprising:

a plurality of subcomponents each of which is T-shaped in transverse cross-sectional shape;

each said T-shaped subcomponent comprising a faceplate having two opposite longitudinal edges, a longitudinal rib plate having two opposite longitudinal edges, and a two-plate longitudinal T-weld by which one said edge of each said longitudinal rib plate is welded to a respective said faceplate at a site which is disposed intermediate the respective said two opposite longitudinal edges of the respective said faceplate;

said T-shaped subcomponents being arranged adjacent one another girthwise of said vessel hull construction, with relative rotation through 180 degrees about respective longitudinal axes thereof, so that faceplates of successive ones of said subcomponents are arranged to provide respective portions of inner and outer hulls of said vessel hull construction;

said subcomponents being united into said subassembly by respective longitudinal three-plate, three-edge welds each formed between respective said longitudinal edges of two adjacent faceplates which are arranged to provide respective portions of a respective same one of said inner and outer hulls and a respective other said edge of a respective said longitudinal rib plate.

2. The subassembly of claim 1, wherein:

all of said faceplates which are arranged to provide respective portions of said inner hull are substantially flat plates.

3. The subassembly of claim 1, wherein:

all of said faceplates which are arranged to provide respective portions of said outer hull are substantially flat plates.

4. The subassembly of claim 1, wherein:

all of said faceplates which are arranged to provide respective portions of said inner and outer hulls are substantially flat, rectangular plates.

5. The subassembly of claim 1, wherein:

all of said longitudinal rib plates substantially flat plates, having transversally extending kick-plate stiffeners welded to respective one faces thereof at regular intervals therealong.

6. The subassembly of claim 1, wherein:

all of said faceplates and longitudinal rib plates are made of steel.

7. The subassembly of claim 6, wherein:

all otherwise exposed surfaces of said subassembly bear a protective coating of paint.

8. The subassembly of claim 1, incorporated with horizontal disposition in a vessel so that said faceplates which form respective portions of said inner hull are substantially flat and form respective portions of a bottom of said vessel.

* * * * *

UNITED STATES PATENT AND TRADEMARK OFFICE

CERTIFICATE OF CORRECTION

PATENT NO. : 5,293,830

DATED : March 15, 1994

INVENTOR(S) : GOLDBACH, Robert D.

It is certified that error appears in the above-indentified patent and that said Letters Patent is hereby corrected as shown below:

On the title page, item

--[73] Assignee: Metro Machine Corp., Norfolk, Va.
(undivided one-half interest)--

Signed and Sealed this

Twenty-ninth Day of November, 1994

*Attest:*

Bruce Lehman

BRUCE LEHMAN

*Attesting Officer*

*Commissioner of Patents and Trademarks*